United States Patent [19]

von Renteln

[11] 4,412,199

[45] Oct. 25, 1983

[54] REGULATING WINDING CONNECTED IN SERIES WITH A MAIN WINDING OF A TRANSFORMER

[75] Inventor: Adrian von Renteln, Ludvika, Sweden

[73] Assignee: ASEA Aktiebolag, Västeras, Sweden

[21] Appl. No.: 278,021

[22] Filed: Jun. 29, 1981

[30] Foreign Application Priority Data

Jul. 8, 1980 [SE] Sweden ..... 8005009

[51] Int. Cl.[3] ..... H01F 15/14; H01F 21/12

[52] U.S. Cl. ..... 336/70; 336/150; 336/180; 336/183

[58] Field of Search ..... 336/69, 70, 180, 182, 336/183, 84 R, 84 C, 150, 192

[56] References Cited

U.S. PATENT DOCUMENTS

| | | | |
|---|---|---|---|
| 2,279,027 | 4/1942 | Weed et al. | 336/70 |
| 3,113,281 | 12/1963 | Ayers | 336/70 X |
| 3,392,356 | 7/1968 | Costsaftis et al. | 336/180 |
| 3,466,584 | 9/1969 | Kashima | 336/70 |

*Primary Examiner*—Thomas J. Kozma

*Attorney, Agent, or Firm*—Pollock, Vande Sande & Priddy

[57] ABSTRACT

The invention relates to a regulating winding for a transformer in which a plurality of helical current-carrying conductor loops are connected in series with each other, whereas a plurality of non-current-carrying helical potential control loops are provided adjacent to the current-carrying loops and are connected to appropriate ones of the current-carrying loops in such a way that a substantial increase in the series capacity of the regulating winding is obtained with a relatively small increase in the space required for the regulating winding.

4 Claims, 4 Drawing Figures

REGULATING WINDING CONNECTED IN SERIES WITH A MAIN WINDING OF A TRANSFORMER

TECHNICAL FIELD

This invention relates to a multi-turn regulating winding arranged in a transformer and provided with a plurality of connecting contacts (e.g. for an on-load tap-changer) arranged at different potentials, the separate turns of the regulating winding being series-connected with each other. Such regulating windings are known from Swedish Pat. No. 389,942 and from published German Patent Application No. 2,938,531.

DISCUSSION OF PRIOR ART

During transient oscillations, high voltages will often occur across the regulating winding, especially across the end portions of the regulating winding. It is known that these overvoltages are dependent on the capacitive coupling between the different turns of the regulating winding in such a way that a relatively strong capacitive coupling gives lower overvoltages than those obtained when there is a relatively weak capacitive coupling. When designing a regulating winding, the aim is therefore to obtain as high a value as possible for the so-called series capacitance of the regulating winding, or in other words, the aim is to maximize the ability of the regulating winding to store capacitive energy. It is thus known to arrange, for this purpose, an electrostatic screen radially outside the regulating winding. Such a screen has a uniform potential equal to that of its point of connection to the winding. This means that the electrical insulation between the electrostatic screen and the regulating winding must be capable of withstanding the total voltage across the regulating winding, which sets a limit on the increase in the series capacitance that may be attained with the aid of an electrostatic screen, and, since the screen must be spaced a relatively large distance away from the winding, the use of an electrostatic screen considerably increases the space required for the regulating winding.

DISCLOSURE OF THE INVENTION

According to the invention there is provided a regulating winding arranged in a transformer and provided with a plurality of connecting contacts, arranged at different potentials, each connecting contact representing a corresponding regulating step, said winding comprising a plurality of multi-turn, substantially helical current-carrying conductor loops, said current-carrying conductor loops being electrically insulated from each other and arranged in such a way that each one of said current-carrying conductor loops has a first end point at the one end of said winding and a second end point at the other end of said winding, a plurality of electrical connecting elements arranged to connect a plurality of said first end points to a plurality of said second end points in such a way that said helical current-carrying conductor loops are thereby series-connected with each other, each of said connecting elements being connected to a respective one of said connecting contacts, which is characterized in that said winding also comprises a plurality of insulated, helical potential loops, each of which is arranged with at least one surface portion thereof facing an adjoining surface portion of at least one of said current-carrying conductor loops along at least part of the length thereof, each of said potential loops at one or the other end of said winding having an end point, which by means of electrical connecting means, is placed in electrical connection with an end point of a corresponding current-carrying conductor loop located at the same end of the winding, whereby each potential loop has a surface portion confronting an adjacent surface portion belonging to a current-carrying conductor loop, but not to the current-carrying conductor loop which is electrically connected to that potential loop.

BRIEF DESCRIPTION OF DRAWINGS

The invention will now be described, by way of example, with reference to the accompanying drawings, in which.

DESCRIPTION OF PREFERRED EMBODIMENTS

Figure 1:
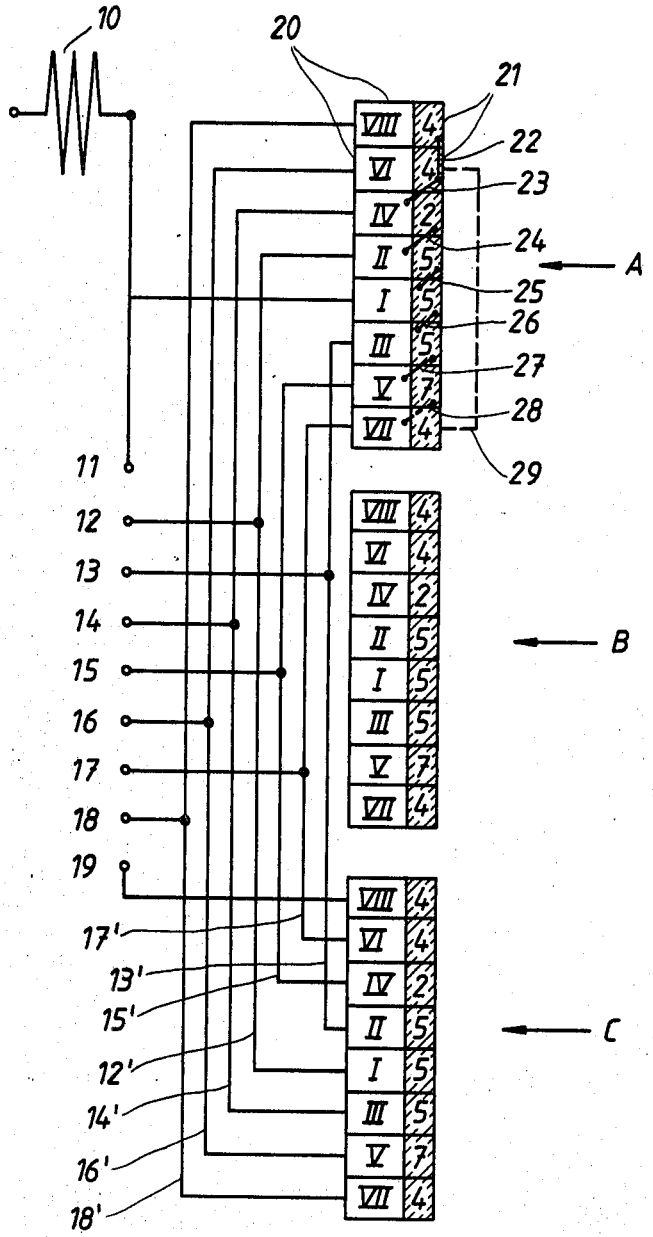
FIGS. 1, 2, 3 and 4 show axial sections through the cylinder wall of four different embodiments of a regulating winding according to the invention.

In each embodiment, the regulating winding is a substantially hollow cylindrical body and in the interests of clarity, the cross-sectional surfaces of the current-carrying conductor loops of the windings shown in the drawings have not been provided with the conventional hatching normally used to indicate a cross-section.

The regulating winding shown in FIG. 1 has been provided by collecting eight electrically insulated copper bars 20 of rectangular cross-section and eight electrically insulated copper bars 21 also of rectangular cross-section in one bundle, the bars 21 being shown as having the same height but smaller width, that the bars 20. The bundle of bars 20, 21 is wound in two full turns so as to form a substantially hollow cylindrical body with a vertical axis. The sectional surfaces shown in FIG. 1 all lie in the same axial plane, the sectional surfaces indicated by the arrow A representing the beginning of the uppermost turn, the sectional surfaces indicated by the arrow B representing the transition between the first and the second turn, and the sectional surfaces indicated by the arrow C representing the end of the second turn.

The conductors 20 thus form eight helical current-carrying loops and the conductors 21 form eight helical potential loops. The current-carrying conductor loops, which are designated by the Roman numbers I–VIII, are series-connected with each other by means of a plurality of electrical connecting elements shown schematically at 12'–18', and these elements are each provided with a corresponding connecting contact 12–18 corresponding to the different regulating steps of the winding. The upper end of the current-carrying carrying conductor loop I is shown connected to a connecting contact 11 and to one end point of a main winding 10 of the transformer, which together with the regulating winding is wound around a transformer leg (not shown). The Roman numbers I–VIII indicate the sequence in which the corresponding current-carrying conductor loops are series-connected. The lower end of the current-carrying conductor loop VIII is connected to a contact 19 which represents the highest regulating stage in a regulating winding having the same winding direction as the main winding 10.

In each of the potential loops, the upper end thereof is held at the same potential as the upper end of some of the current loops II, IV, V, VII by means of one of a plurality of potential connections 22–29. In the drawings, each potential loop is provided with a number corresponding to the Roman number of the current-carrying conductor loop to the upper end of which the upper end of that potential loop is electrically connected. No potential loop is directly connected to an immediately adjacent current-carrying conductor loop, which means that the potential difference between any point in a current loop and the nearest point in an adjacent potential loop is always greater than zero. With the current loop I, this potential difference during normal operation is equal to the voltage appearing across the series-connected current loops I, II, III and IV, and with the current loop VIII, the above-mentioned potential difference is equal to the voltage appearing across the series-connected current loops IV, V, VI and VII. Thus with both current loops I and VIII the potential difference is equal to 50% of the full voltage appearing across the regulating winding. With the current loops II and VII, the potential difference in question is equal to 37.5% of the full voltage appearing across the regulating winding, the corresponding potential difference for each of the current loops III, IV, V and VI being 25% of the full regulating winding voltage.

Figure 2:
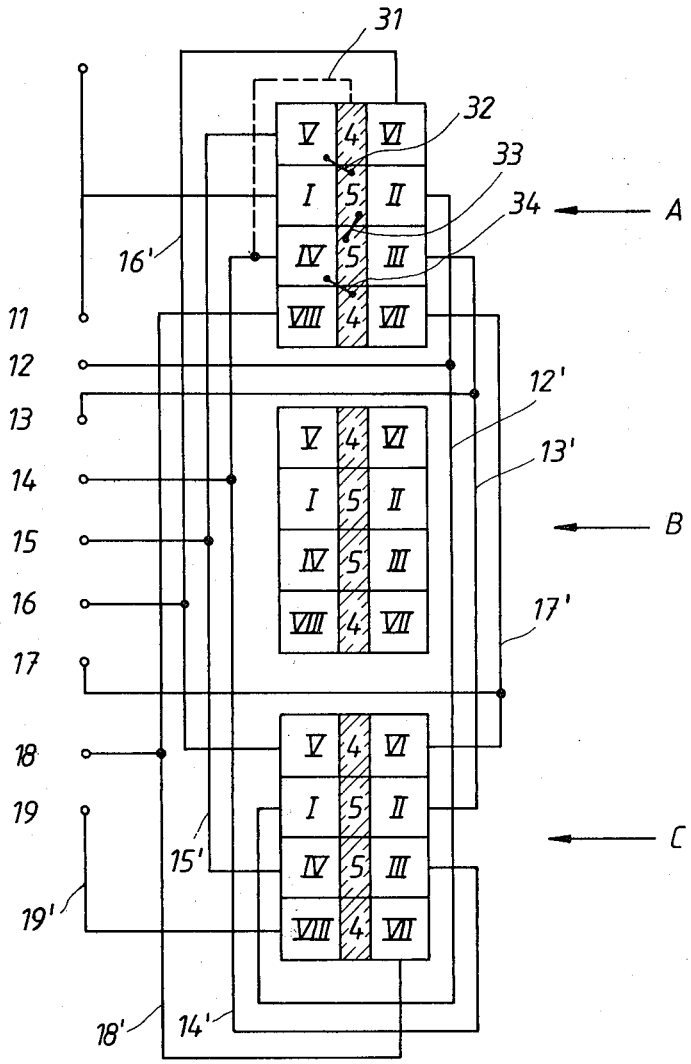
Figure 3:
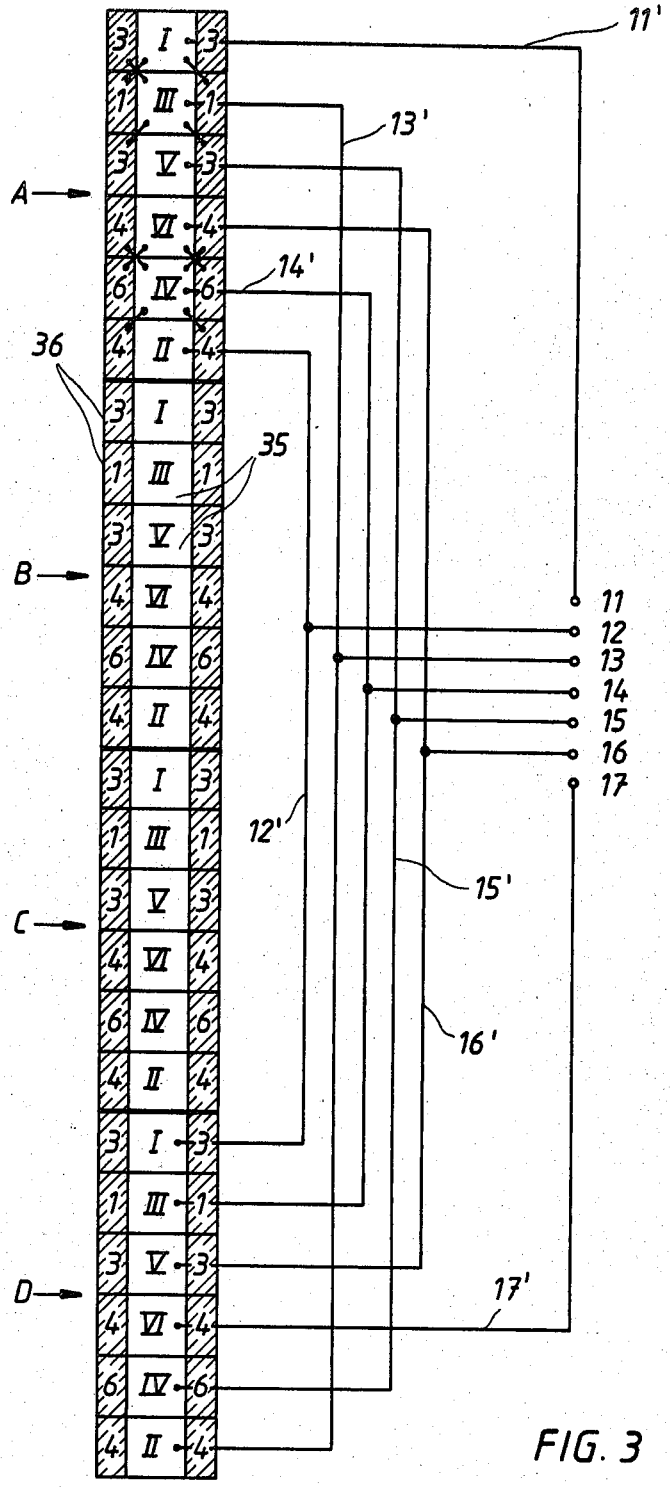
Figure 4:
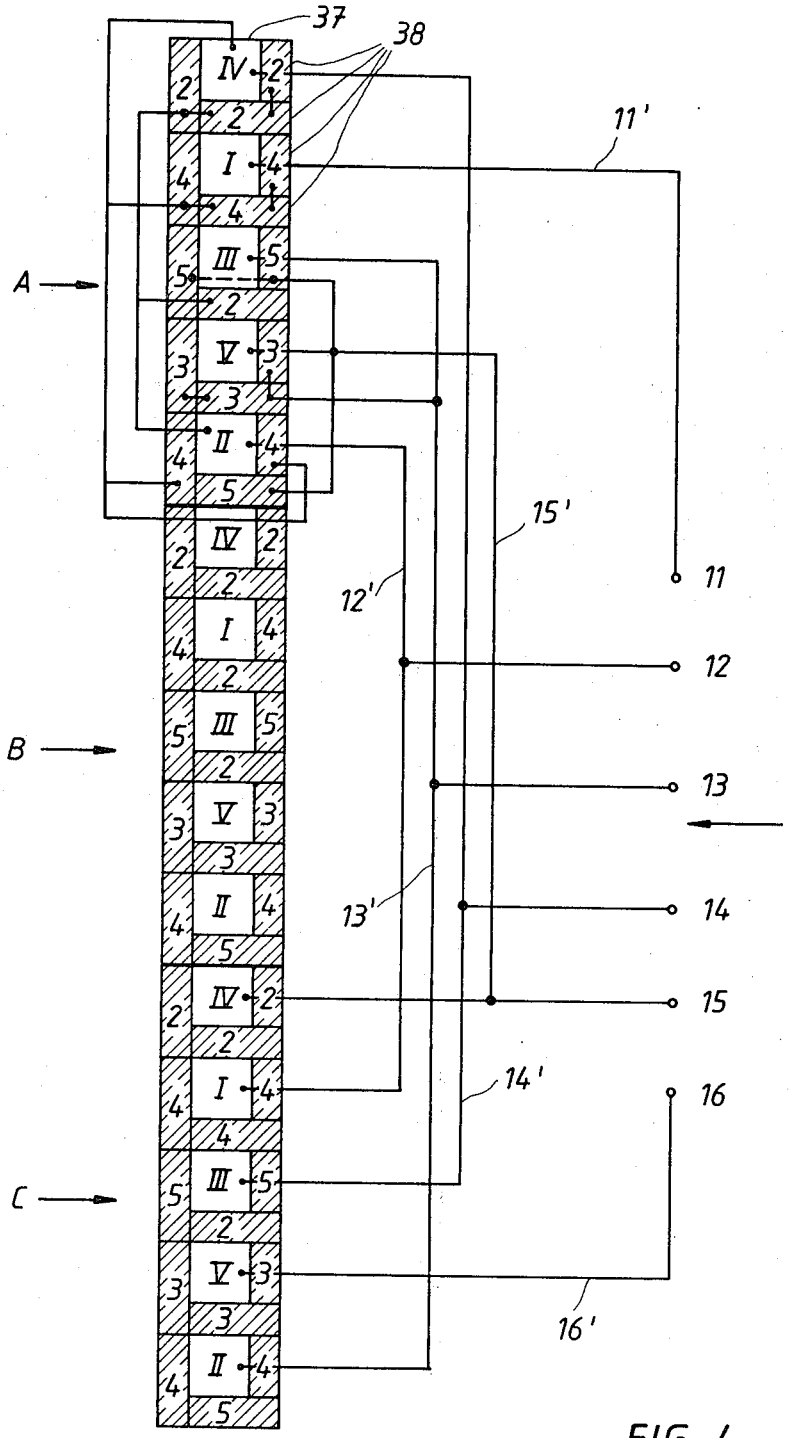

In FIGS. 2, 3 and 4, reference numerals which are also used in FIG. 1 denote the same items.

The regulating winding shown in FIG. 2—which is similar to that shown in FIG. 1—defines a substantially hollow cylindrical body which is formed by winding a conductor bundle two full turns along a helical line. For the sake of clarity, the winding shown in FIG. 2 has also been drawn with gaps between the turns. The winding has a vertical longitudinal axis and each turn comprises eight substantially helical current-carrying conductor loops. These are arranged with two loops forming a pair in the radial direction so that only four potential loops are required, the opposite side surfaces of each potential loop facing and making mechanical contact with a different one of the current loops in each pair.

As in the embodiment shown in FIG. 1, the potential loops are arranged in direct electrical connection with each other or with a current loop only at the upper end of the winding. The corresponding potential connections are designated 31, 32, 33 and 34 in FIG. 2.

The potential difference between any point in any of the current loops I and VIII and the nearest point in an adjacent potential loop is equal to the voltage across four series-connected current loops, thus representing 50% of the total voltage appearing across the regulating winding. The corresponding potential differences of the current loops II and VII are 37.5%, of the current loops III and VI 25%, and of the current loops IV and V 12.5%, which last mentioned potential difference is equal to the voltage appearing across a single current loop.

In the regulating winding shown in FIG. 3, the partial sectional surfaces A, B, C and D lie in an axial plane through the wall of a substantially hollow cylindrical body, which again is shown as having a vertical axis but which now consists of three turns of a conductor bundle, each turn consisting of six insulated copper bars 35 of rectangular, relatively large cross-section forming the current loops and twelve insulated copper bars 36 of the same height as the bars 35, but of reduced width, the bars 36 forming the voltage loops. The sectional surface indicated by the arrow A represents the start of the first turn and the sectional surface indicated by the arrow D represents the end of the third turn. The winding thus contains six insulated, substantially helical current conductor loops I–VI and twelve insulated, substantially helical potential loops, the two opposite side surfaces of each current loop being each arranged in mechanical contact with a different potential loop along the entire length of the winding. The invention also includes arrangements in which contact between the current and voltage loops only exists along part of the length of at least some of the current loops. By means of a plurality of potential connections (indicated by short lines in FIG. 3, but not numbered), the upper ends of the potential loops and the upper ends of the current loops are connected together in pairs. In the same way as in FIGS. 1 and 2, each of the potential loops in FIG. 3 is provided with a number corresponding to the Roman number of the current loop to which it is connected. The current loops I–VI are series-connected to each other by means of a plurality of connecting elements 12'–16', which are provided with corresponding connecting contacts 12–16 intended for an on-load tap changer. In all current loops I-14 VI and at each point thereof, the potential in relation to the nearest point of any adjoining potential loop is equal to the voltage across two series-connected current loops, that is, in normal operation it is equal to 33.3% of the voltage appearing across the entire regulating winding.

In the regulating winding shown in FIG. 4, the partial sectional surfaces designated by the arrows A, B and C lie in an axial plane through the wall of a substantially hollow cylindrical body again shown with its axis vertical. The winding illustrated in FIG. 4 consists of a substantially helical bundle of copper bars having two turns, the sectional surface indicated by the arrow A lying at the start of the first turn, the sectional surface indicated by the arrow B representing the transition between the first and the second turn, and the sectional surface indicated by the arrow C representing the end of the second turn. In FIG. 4, the bundle contains five insulated copper bars 37 of rectangular, relatively large cross-section, which form five equally long helical current loops I–V, and fifteen insulated copper bars 38 each of smaller rectangular cross-section than the bars 37, which bars 38 form fifteen helical potential loops. The current loops are series-connected to each other by means of a plurality of electric connecting elements 12'–15', each of which is provided with a respective connecting contact 12–15. The end points of the series-connected group are connected to contacts 11 and 16 via connections 11' and 16'. The potential loops are again provided with numerals corresponding to the Roman numbers of the current loops to which the potential loops are connected at their upper ends.

In the current loop I, the four limiting surfaces of the bar 37 forming the loop each makes contact with a corresponding potential loop, with a potential difference of respectively one, three, three and three times the voltage appearing across the current loop. Expressed in the same manner, the potential differences of the voltage loops surrounding the current loop V are three, two, two and two, the potential differences in the case of the current loop II are two, two, one and one, whereas the potential differences in the case of the current loop II are two, three, two and one. The potential differences of the current loop IV in relation to each of the three adjoining potential loops at the upper end of the winding are twice the voltage across a current loop. At other places in the winding the current conductor loop IV also makes contact with a potential loop positioned above it and has in relation thereto a potential which is equal to the voltage across one current loop.

In all the embodiments of the invention, each one of a plurality of potential loops has, at one or the other end of the regulating winding, an end which is arranged in electrical connection with an end, located at the same end of the winding, of a current loop which does not make mechanical contact via any of its side surfaces with the potential loop.

In the drawings, all the connections between the current loops and the potential loops have been shown to be located at the upper end of the winding. It is, of course, equally possible to use connection points which are only positioned at the lower end of the winding, or indeed to arrange some of these connections at the upper end of the winding and the remainder at the lower end of the winding.

Although the illustrated embodiments all show the connections between loop ends positioned at the same end of the winding, this does not mean that the corresponding connecting wires have to be positioned at one end or the other end only of the winding. Thus, for example, the upper end of a potential loop can be directly connected to the lower end of a first current loop, so that the upper potential loop end is effectively also connected to the upper end of the second, series-connected current loop which follows immediately after the first current loop in the series group.

In the embodiments of the invention shown in the drawings, each current loop contains only one conductor. The invention also includes the case where each current loop is formed by a conductor which consists of a plurality of individually insulated and mutually parallel-connected bars or wire bundles of electrically conducting material.

What is claimed is:

1. A regulating winding arranged in a transformer and provided with a plurality of connecting contacts, arranged at different potentials, each connecting contact representing a corresponding regulating step, said winding comprising a plurality of multi-turn, substantially helical current-carrying conductor loops, said current-carrying conductor loops being electrically insulated from each other and arranged in such a way that each one of said current-carrying conductor loops has a first end point at the one end of said winding and a second end point at the other end of said winding, a plurality of electrical connecting elements arranged to connect a plurality of said first end points to a plurality of said second end points in such a way that said helical current-carrying conductor loops are thereby series-connected with each other, each of said connecting elements being connected to a respective one of said connecting contacts, characterized in that said winding also comprises a plurality of insulated helical potential loops, each of which is arranged with at least one surface portion thereof facing an adjoining surface portion of at least one of said current-carrying conductor loops along at least part of the length thereof, each of said potential loops at one or the other end of said winding having an end point which by means of electrical connecting means, is placed in electrical connection with an end point of a corresponding current-carrying conductor loop located at the same end of the winding, whereby each potential loop has a surface portion confronting the adjacent surface portion belonging to a current-carrying conductor loop, but not to the current-carrying conductor loop which is electrically connected to that potential loop.

2. A regulating winding according to claim 1, in which the number of current-carrying conductor loops deviates from the number of potential loops, each loop of one type being positioned between two loops of the other type.

3. A regulating winding according to claim 2, in which a plurality of said current-carrying conductor loops are each surrounded by four potential loops each of which makes contact with the current-carrying conductor loop.

4. A regulating winding according to claim 3, in which each current-carrying conductor loop is formed from rectangular section material and each of said four potential loops contacts a different side of the said current-carrying loop.

* * * * *